US008721508B2

(12) United States Patent
Tseng

(10) Patent No.: US 8,721,508 B2
(45) Date of Patent: May 13, 2014

(54) COUNTERBALANCE DEVICE FOR WEIGHT TRAINING

(76) Inventor: Sheng-Kuo Tseng, Taichung (TW)

( * ) Notice: Subject to any disclaimer, the term of this patent is extended or adjusted under 35 U.S.C. 154(b) by 420 days.

(21) Appl. No.: 13/288,071

(22) Filed: Nov. 3, 2011

(65) Prior Publication Data

US 2013/0116097 A1 May 9, 2013

(51) Int. Cl.
*A63B 21/02* (2006.01)
*A63B 21/06* (2006.01)
*F16F 1/06* (2006.01)

(52) U.S. Cl.
USPC ..... 482/121; 482/93; 267/174

(58) Field of Classification Search
USPC ..... 482/92–94, 98–103, 121, 128–130; 267/69–71, 73, 74, 169, 174, 175, 177; 248/325, 334.1, 648; 414/601, 602
See application file for complete search history.

(56) References Cited

U.S. PATENT DOCUMENTS 5,462,518 A * 10/1995 Hatley et al. ..... 602/36
5,553,836 A * 9/1996 Ericson ..... 267/286
5,643,160 A * 7/1997 Huang ..... 482/126
6,468,189 B2 * 10/2002 Alessandri ..... 482/99
6,640,395 B2 * 11/2003 Bush ..... 24/68 CD
7,293,764 B2 * 11/2007 Fang ..... 267/220
7,473,211 B2 * 1/2009 Lee ..... 482/97
8,490,953 B2 * 7/2013 Luke et al. ..... 267/70
8,646,762 B2 * 2/2014 Krajenke et al. ..... 267/170

* cited by examiner

*Primary Examiner* — Loan H Thanh
*Assistant Examiner* — Gregory Winter
(74) *Attorney, Agent, or Firm* — Alan Kamrath; Kamrath IP Lawfirm, P.A.

(57) ABSTRACT

A counterbalance device for weight training includes a brake unit and a control unit. The brake unit includes an outer cylinder, a resistant spring received in the outer cylinder, and a screw rod extending through the outer cylinder and the resistant spring. The screw rod is connected with a steel cable of a weight training apparatus. An adjusting member is coupled around the screw rod and movably threaded into the resistant spring. A gear is provided at a front end of the resistant spring. The control unit includes a transmission gear which can be driven by a motor and is engaged with the gear. When the motor is actuated, a position of the adjusting member relative to the resistant spring can be changed, so that a number of spring coils of the resistant spring for compressing are changed, therefore a counterbalance of the weight training apparatus can be adjusted.

10 Claims, 7 Drawing Sheets

COUNTERBALANCE DEVICE FOR WEIGHT TRAINING

BACKGROUND OF THE INVENTION

1. Field of the Invention

The present invention relates to a counterbalance device for weight training and, more particularly, to a counterbalance device which uses an elasticity of a spring to resist a force exerted by a user.

2. Description of the Related Art

FIG. 1 shows a conventional fitness apparatus 10 used for weight training. The fitness apparatus 10 includes a plurality of counterbalancing members 14 made of cast iron which can slide on two guiding rails 15. An insertion bar 13 is inserted in middle portions of the counterbalancing members 14 and includes a plurality of holes 131 for coupling with the counterbalancing members 14 by forelocks, so that when the fitness apparatus 10 is under operation, the insertion bar 13 and the counterbalancing members 14 coupled with the insertion bar 13 are pulled upward by a steel cable 12. When a force is not exerted by a user, the uplifted counterbalancing members 14 will be moved downward. A weight of the counterbalancing members 14 is used for resisting an exerted force of the user, therefore a fitness effect can be achieved. However, the fitness apparatus 10 has the following drawbacks:

1. The counterbalancing members 14 are made of cast iron, and when they are moved downward, a loud noise is produced because they collide with each other.

2. Because physical capability of every user is different, thus the weight of the counterbalancing members 14 needs to be adjusted very often. When it is needed to adjust the weight of the counterbalancing members 14, one or more pieces of the counterbalancing members 14 is needed to be removed or added, and it is very inconvenient for dismounting or assembling. Further, the heavy weight of the counterbalancing members 14 makes it difficult to carry.

BRIEF SUMMARY OF THE INVENTION

Thus, an objective of the present invention is to provide a safe and noiseless counterbalance device for weight training to improve the aforementioned problems. The counterbalance device is adapted to be engaged with a pulling rope or steel cable for a weight training apparatus. Furthermore, an elasticity of counterbalance of the counterbalance device can be conveniently adjusted to resist a force exerted by a user. In addition, the counterbalance device is light to carry.

To achieve this and other objectives, a counterbalance device for weight training of the present invention includes a brake unit and a control unit. The brake unit includes an outer cylinder, a resistant spring, a screw rod, and an adjusting member. The resistant spring is received in the outer cylinder, and a gear is engaged to a front end of the resistant spring. The screw rod extends through the outer cylinder and the resistant spring and includes a threaded section and a front section. The front section of the screw rod extends through the gear such that the gear and the screw rod can be turned together. The front section of the screw rod is adapted to be connected with a steel cable of a weight training apparatus. The adjusting member is screwed around the threaded section of the screw rod and includes an outer thread disposed on an outer circumference thereof. The adjusting member is threadedly engaged in the resistant spring. The control unit includes a motor. The motor is coupled with a transmission gear engaged with the gear of the brake unit. When the screw rod is pulled, the adjusting member is moved with the screw rod together to compress the resistant spring. When the motor is actuated, a position of the adjusting member relative to the resistant spring can be changed, so that a number of spring coils of the resistant spring which can be compressed are also changed.

In a preferred form, the screw rod includes a coupling portion extending from a front end of the front section of the screw rod and protruded outside the sleeve for connecting with the steel cable of the weight training apparatus.

In another preferred form, the screw rod includes a screw hole disposed in the front section thereof, and a screw extends through a through-hole of a coupling ring and screwed into the screw hole. The coupling ring is adapted to be connected to the steel cable of the weight training apparatus.

Preferably, the brake unit further includes a sleeve secured on a front end of the gear. The control unit further includes a fixing plate having a through-hole through which the sleeve and the front section of the screw rod extend. A gasket is mounted around the sleeve and placed on the fixing plate, and a nut is threadedly engaged with the sleeve to secure the fixing plate to the outer cylinder. A groove is disposed in the outer cylinder. The brake unit further includes a fixing member installed on the outer cylinder, and an inner portion of the fixing member is inserted in the groove of the outer cylinder to releasably secure the adjusting member to the screw rod.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
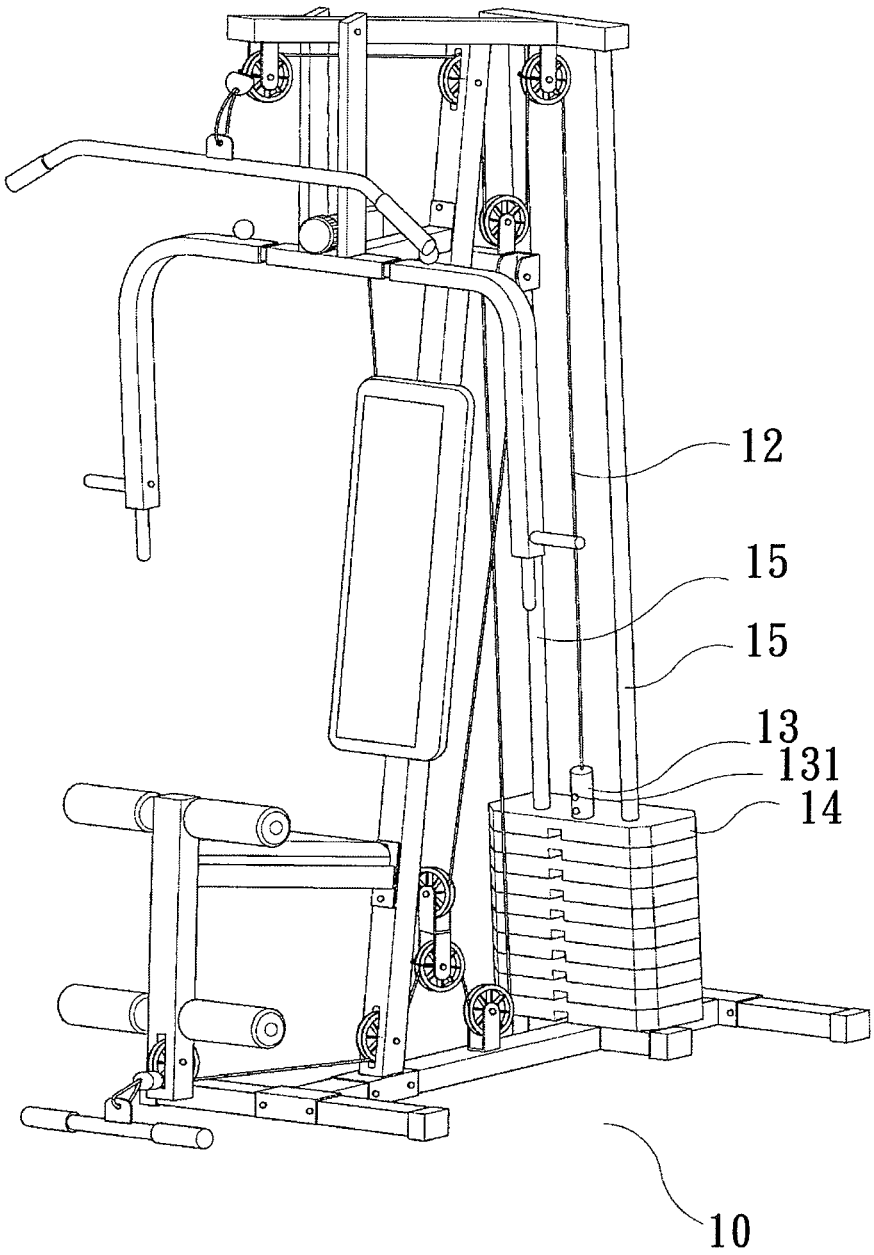
FIG. 1 Prior Art
FIG. 1 is a perspective view of a conventional fitness apparatus.
Figure 2:
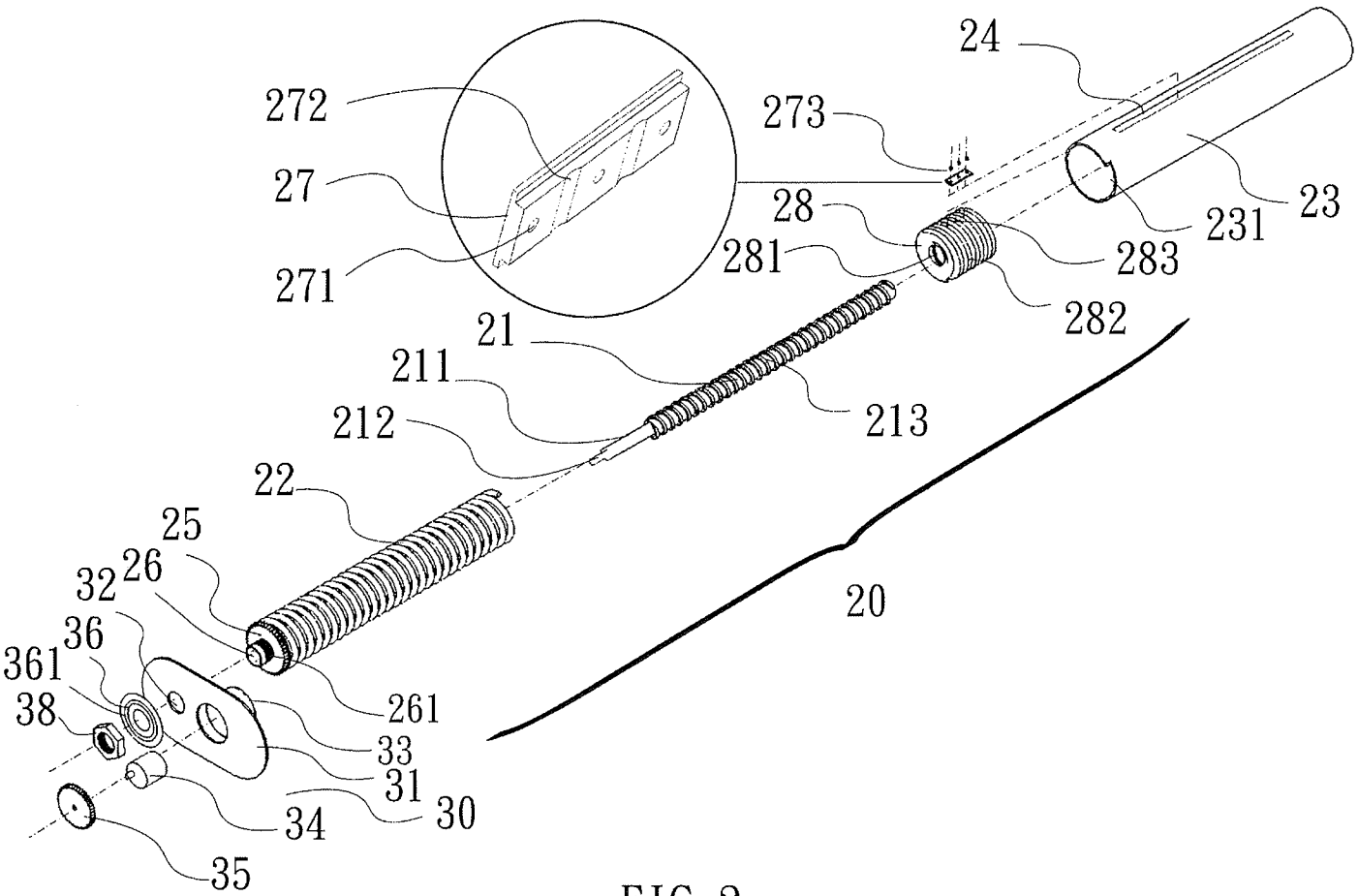
FIG. 2 is an exploded, perspective view of a counterbalance device according to the preferred teachings of the present invention.
Figure 3:
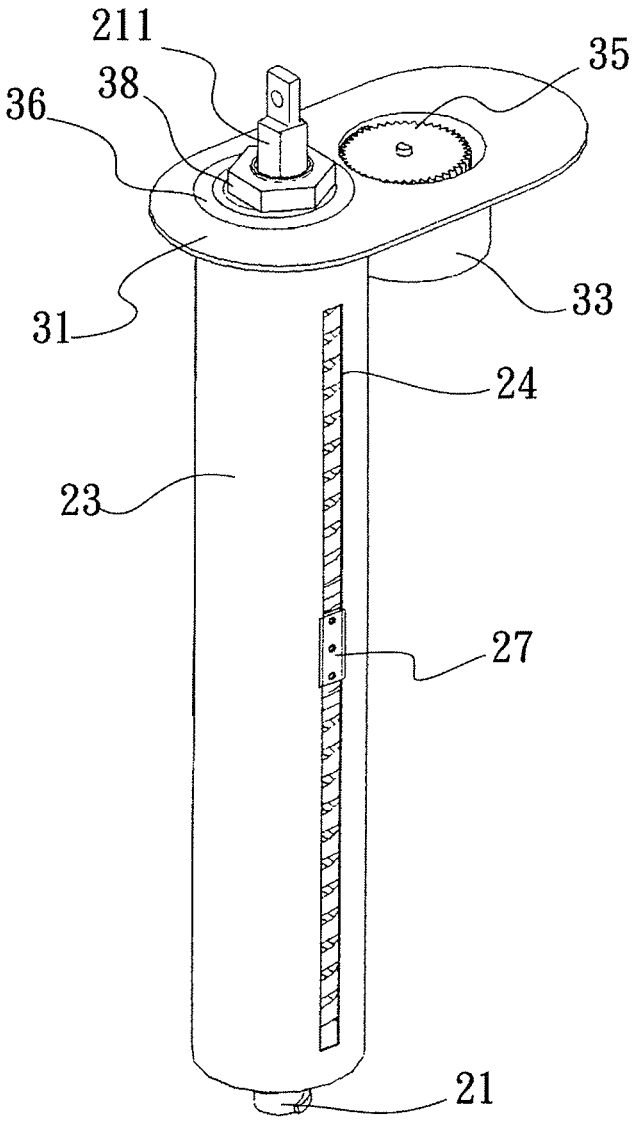
FIG. 3 is a perspective view of the counterbalance device of FIG. 2.
Figure 4:
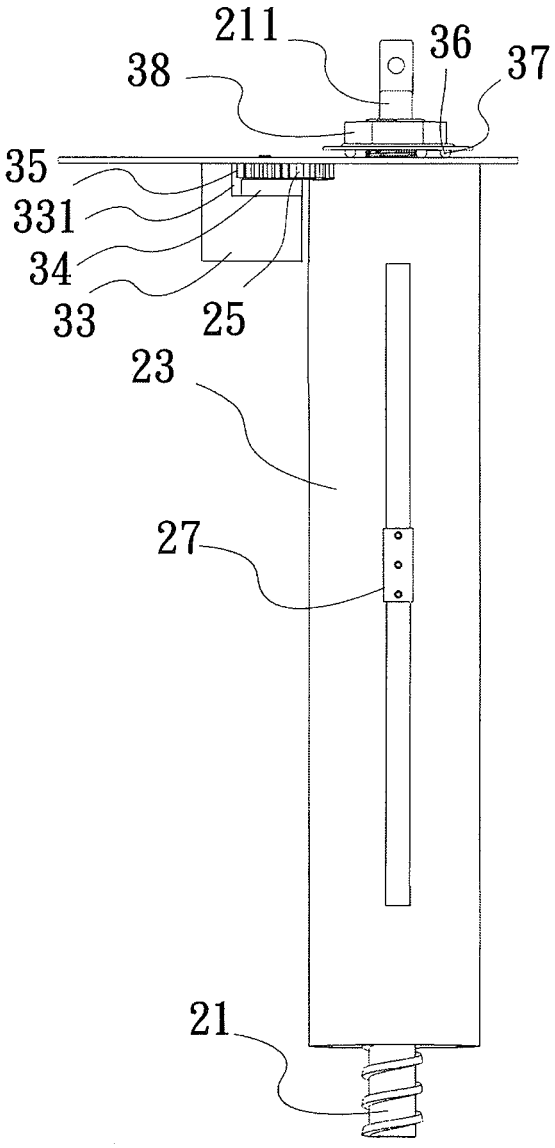
FIG. 4 is a side view of the counterbalance device of FIG. 3.
Figure 5:
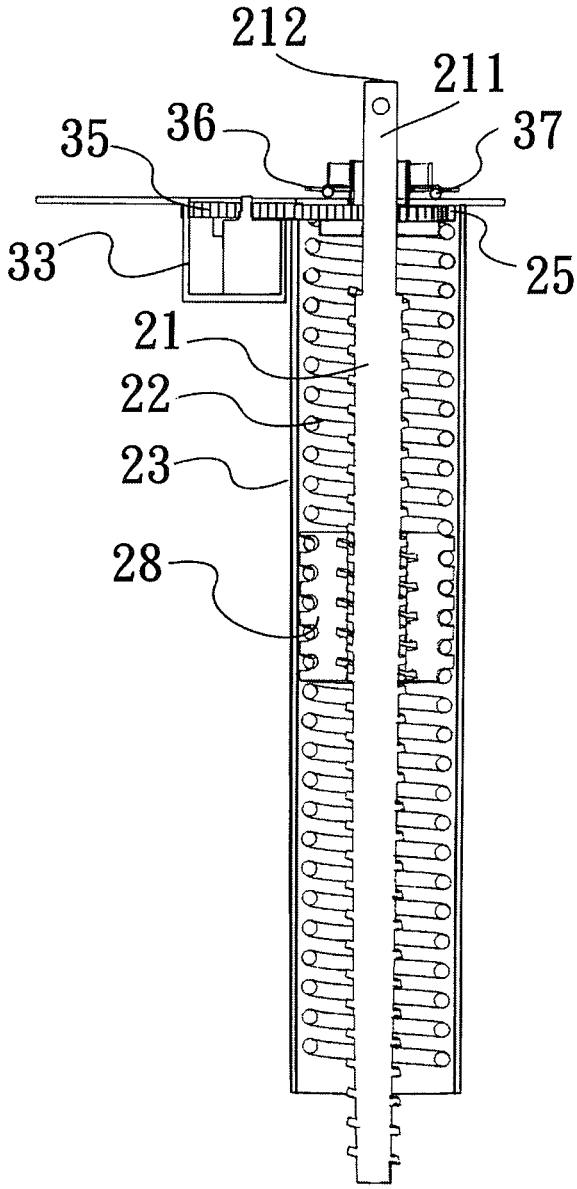
FIG. 5 is a cross-sectional view of the counterbalance device of FIG. 3.

A counterbalance device for weight training according to the preferred teachings of the present invention is shown in FIGS. 2 through 7 of the drawings and generally includes a brake unit 20 and a control unit 30. The brake unit 20 includes an outer cylinder 23, a resistant spring 22, a screw rod 21, and an adjusting member 28. A groove 24 is disposed and extended axially on the outer cylinder 23, and a notch 231 is formed in a front end of the outer cylinder 23. The resistant spring 22 is a spiral spring and received in the outer cylinder 23. A gear 25 is engaged on a front end of the resistant spring 22 and includes a square center hole. The gear 25 is disposed inside the front end of the outer cylinder 23 and adjacent to the notch 231. A sleeve 26 with an outer thread 261 is secured on a front end of the gear 25. The screw rod 21 extends through the outer cylinder 23 and the resistant spring 22 and includes a threaded section 213 and a non-threaded front section 211.

Figure 6:
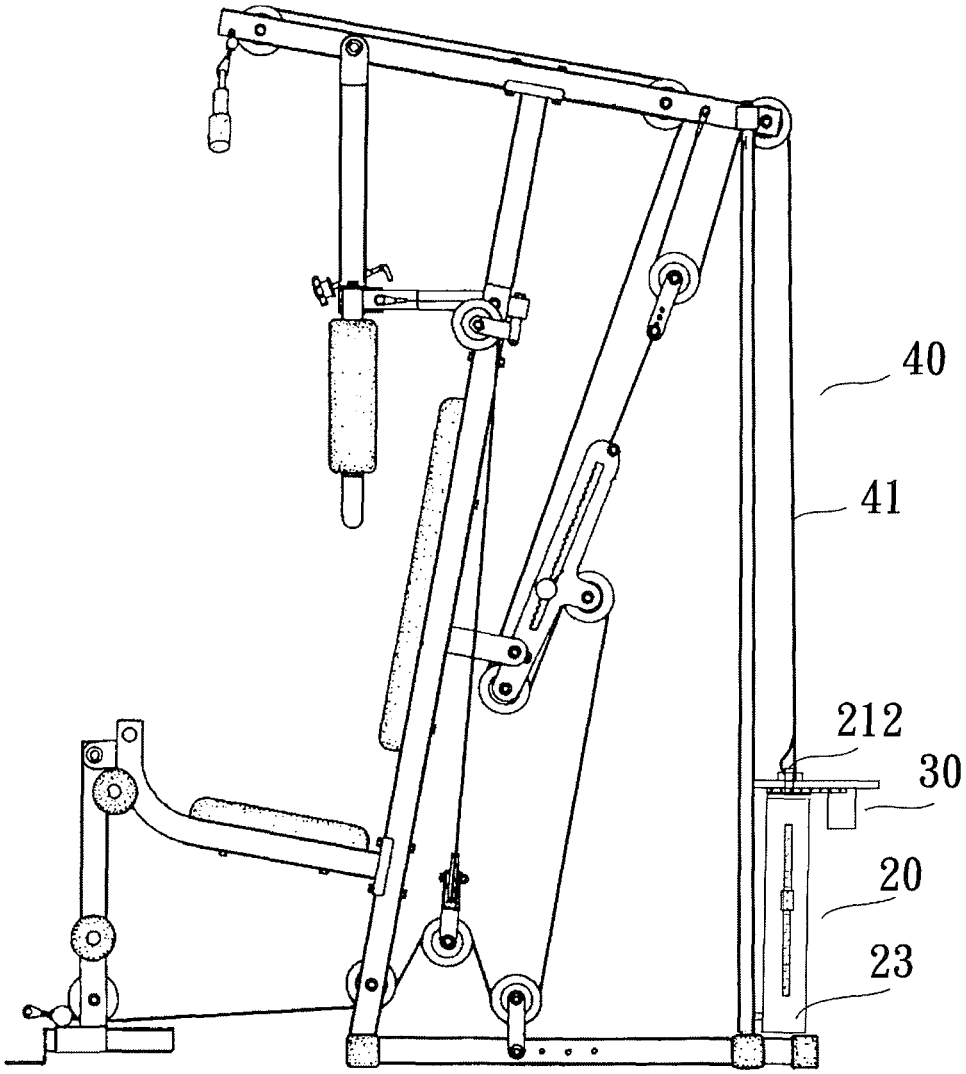
FIG. 6 is an illustration of a weight training apparatus assembled with the counterbalance device of the present invention.

The front section 211 of the screw rod 21 has a non-circular cross-sectional surface for correspondingly inserting into the center hole of the gear 25, so that the gear 25 and the screw rod 21 can be turned together. A coupling portion 212 is extended from a front end of the front section 211 of the screw rod 21 and protruded out of the sleeve 26 for connecting with a steel cable 41 of a weight training apparatus 40 as shown in FIG. 6, so that the screw rod 21 can be pulled by operation of the weight training apparatus 40.

The adjusting member 28 includes a screw hole 281 therein for screwing around the threaded section 213 of the screw rod 21. The adjusting member 28 has an outer diameter approximately the same as an inner diameter of the resistant spring 22. An outer thread 282 is formed on an outer circumference of the adjusting member 28 and has a thread pitch approximately the same as a spring coil spacing of the resistant spring 22, so that the adjusting member 28 can be rotatably received and threadedly engaged in the resistant spring 22. When a position of the adjusting member 28 relative to the resistant spring 22 is changed, a number of spring coils of the resistant spring 22 for compressing or pulling can be adjusted. Furthermore, a plurality of fixing holes 283 is disposed in the outer circumference of the adjusting member 28 for engaging with a fixing member 27. The fixing member 27 is installed on the outer cylinder 23, and an inner portion of the fixing member 27 is inserted into the groove 24 of the outer cylinder 23. The fixing member 27 has locking holes 271 corresponding to the fixing holes 283 and recessed portions 272 abutting the spring coils of the resistant spring 22. A plurality of screws 273 is screwed into the fixing holes 283 after they extend through the locking holes 271 of the fixing member 27, so that the adjusting member 28 can be fixed on the screw rod 21. When the screws are loosened, a position of the adjusting member 28 relative to the front section 211 of the screw rod 21 can be adjusted.

The control unit 30 includes a fixing plate 31, a supporting base 33, and a motor 34. The fixing plate 31 has a through-hole 32 through which the sleeve 26 and the front section 211 of the screw rod 21 of the brake unit 20 extend. The front end of the outer cylinder 23 is adjoined to an inner surface of the fixing plate 31. After the front section 211 of the screw rod 21 is extended through and protruded outside the through-hole 32 of the fixing plate 31, a gasket 36 is mounted around the sleeve 26 and placed on an outer surface of the fixing plate 31, then a nut 38 is used to screw on the sleeve 26, so that the outer cylinder 23 and the fixing plate 31 are coupled together. In this embodiment, an annular groove 361 is disposed in a side of the gasket 36, and a plurality of steel balls 37 is disposed between the annular groove 361 of the gasket 36 and the fixing plate 31. When the screw rod 21 is pulled by the steel cable 41 of the weight training apparatus 40, the gasket 36 and steel balls 37 can act as a buffer for turning and deflected swinging. In another embodiment, the gasket 36 can be replaced by a bearing.

The supporting base 33 is provided on the inner surface of the fixing plate 31 and is adjacent to the front end of the outer cylinder 23. The supporting base 33 has an indentation 331 corresponding to the notch 231 of the outer cylinder 23. The motor 34 is received inside the supporting base 33 and coupled with a transmission gear 35. The transmission gear 35 is engaged with the gear 25 of the brake unit 20 through the indentation 331 and the notch 231. When the motor 34 turns (can be actuated by a control button disposed on the weight training apparatus 40), the transmission gear 35 drives the gear 25 to turn. The screw rod 21 and the resistant spring 22 will be driven to turn idle when the gear 25 turns, so that the adjusting member 28 will be rotated and moved forwardly or backwardly relative to the resistant spring 22.

After the counterbalance device of the present invention is assembled with the weight training apparatus 40, the outer cylinder 23 is fixed. When the weight training apparatus 40 is operated and the screw rod 21 is pulled, the adjusting member 28 is moved together with the screw rod 21 to compress a portion of the resistant spring 22; accordingly, an elasticity of the resistant spring 22 can be used to resist a force exerted by a user, therefore a fitness effect can be achieved. Furthermore, a pulling resistance for counterbalance of the weight training apparatus 40 can be conveniently adjusted by the counterbalance device of the present invention. More specifically, when the screws are loosened, the motor 34 can be actuated to turn the gear 25 in order to control a position of the adjusting member 28 relative to the resistant spring 22. When a position of the adjusting member 28 relative to the resistant spring 22 is changed, a number of the spring coils of the resistant spring 22 for compressing are also changed. Specifically, when the adjusting member 28 is moved towards a rear end of the outer cylinder 23, the number of the spring coils of the resistant spring 22 for compressing is increased, and the force required for weight training is decreased. On the contrary, when the adjusting member 28 is moved towards the front end of the outer cylinder 23, the number of the spring coils of the resistant spring 22 for compressing is decreased, and the force required for weight training is increased. After a position of the adjusting member 28 is adjusted, the screws 273 are locked tightly, so that the weight training apparatus 40 can be operated to pull the screw rod 21.

Figure 7:
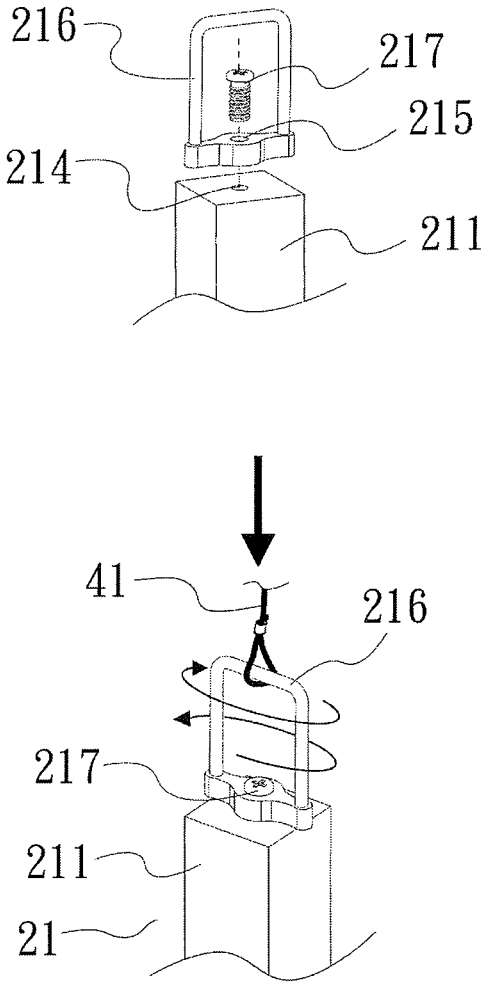
FIG. 7 shows two schematic views illustrating a screw rod of another embodiment of the present invention.

Now that the basic teachings of the present invention have been explained, many extensions and variations will be obvious to one having ordinary skill in the art. The screw rod 21 shown in FIG. 7 is a modification of that shown in FIGS. 2 through 6, wherein the screw rod 21 does not include the coupling portion 212, instead a screw hole 214 is disposed in the front section 211 of the screw rod 21. By using a screw 217 which is extended through a through-hole 215 of a coupling ring 216 and screwed into the screw hole 214, the screw rod 21 can be connected to the steel cable 41 of the weight training apparatus 40 through the coupling ring 216, therefore the screw rod 21 can be pulled by operation of the weight training apparatus 40.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A counterbalance device for weight training, comprising:

a brake unit including an outer cylinder, a resistant spring, a screw rod, and an adjusting member, with the resistant spring received in the outer cylinder, with a gear engaged to a front end of the resistant spring, with the screw rod extending through the outer cylinder and the resistant spring and including a threaded section and a front section, with the front section of the screw rod extending through the gear such that the gear and the screw rod can be turned together, with the front section of the screw rod connected with a steel cable of a weight training apparatus, with the adjusting member screwing around the threaded section of the screw rod and including an outer thread disposed on an outer circumference thereof, with the adjusting member being threadedly engaged in the resistant spring; and a control unit including a motor, with the motor coupled with a transmission gear engaged with the gear of the brake unit, wherein when the screw rod is pulled, the adjusting member is moved with the screw rod together to compress the resistant spring; and wherein when the motor is actuated, a position of the adjusting member relative to the resistant spring can be changed, so that a number of spring coils of the resistant spring which can be compressed are also changed.

2. The counterbalance device for weight training according to claim 1, with the screw rod including a screw hole disposed in the front section thereof, with a screw extending through a through-hole of a coupling ring and screwed into the screw hole, and with the coupling ring connected to the steel cable of the weight training apparatus.

3. The counterbalance device for weight training according to claim 1, with the brake unit further including a sleeve with an outer thread, with the sleeve secured on a front end of the gear, with the control unit further including a fixing plate, with the fixing plate including a through-hole through which the sleeve and the front section of the screw rod extend, with a gasket mounted around the sleeve and placed on an outer surface of the fixing plate, and with a nut threadedly engaged with the sleeve to secure the fixing plate to the outer cylinder.

4. The counterbalance device for weight training according to claim 3, with the screw rod including a coupling portion extending from a front end of the front section of the screw rod and protruding outside the sleeve for connecting with the steel cable of the weight training apparatus.

5. A counterbalance device for weight training, comprising:

a brake unit including an outer cylinder, a resistant spring, a screw rod, and an adjusting member, with the resistant spring received in the outer cylinder, with a gear engaged to a front end of the resistant spring, with the screw rod extending through the outer cylinder and the resistant spring and including a threaded section and a non-threaded front section, with the front section of the screw rod extending through the gear such that the gear and the screw rod can be turned together, with the front section of the screw rod connected with a steel cable of a weight training apparatus, with the adjusting member screwing around the threaded section of the screw rod and including an outer thread disposed on an outer circumference thereof, with the adjusting member being threadedly engaged in the resistant spring; and a control unit including a fixing plate, a supporting base, and a motor received in the supporting base, with the fixing plate including a through-hole through which the front section of the screw rod extends, with the supporting base disposed on an inner surface of the fixing plate, with the motor coupled with a transmission gear which is engaged with the gear of the brake unit, wherein when the screw rod is pulled, the adjusting member is moved with the screw rod together to compress the resistant spring; and wherein when the motor is actuated, a position of the adjusting member relative to the resistant spring can be changed, so that a number of spring coils of the resistant spring which can be compressed are also changed.

6. The counterbalance device for weight training according to claim 5, with the screw rod including a screw hole disposed in the front section thereof, with a screw extending through a through-hole of a coupling ring and screwed into the screw hole, and with the coupling ring connected to the steel cable of the weight training apparatus.

7. The counterbalance device for weight training according to claim 5, with the brake unit further including a sleeve with an outer thread, with the sleeve secured on a front end of the gear and extending through the through-hole of the fixing plate, with a gasket mounted around the sleeve and placed on an outer surface of the fixing plate, with a nut engaged on the sleeve to secure the fixing plate to the outer cylinder, with a groove disposed in the outer cylinder, with the brake unit further including a fixing member installed on the outer cylinder, and with an inner portion of the fixing member being inserted in the groove of the outer cylinder to releasably secure the adjusting member to the screw rod.

8. A counterbalance device for weight training, comprising:

a brake unit including an outer cylinder, a resistant spring, a screw rod, an adjusting member, and a fixing member, with the resistant spring received in the outer cylinder, with a gear engaged to a front end of the resistant spring, with the screw rod extending through the outer cylinder and the resistant spring and including a threaded section and a front section, with the front section of the screw rod extending through the gear such that the gear and the screw rod can be turned together, with the front section of the screw rod connected with a steel cable of a weight training apparatus, with the adjusting member screwing around the threaded section of the screw rod and including an outer thread disposed on an outer circumference thereof, with the adjusting member being threadedly engaged in the resistant spring, with the fixing member installed on the outer cylinder to releasably secure the adjusting member to the screw rod; and a control unit including a fixing plate, a supporting base, and a motor received in the supporting base, with the fixing plate including a through-hole through which the front section of the screw rod extends, with the supporting base disposed on an inner surface of the fixing plate, with the motor coupled with a transmission gear which is engaged with the gear of the brake unit, wherein when the screw rod is pulled, the adjusting member is moved with the screw rod together to compress the resistant spring; and wherein when the motor is actuated, a position of the adjusting member relative to the resistant spring can be changed, so that a number of spring coils of the resistant spring which can be compressed are also changed.

9. The counterbalance device for weight training according to claim 8, with the brake unit further including a sleeve with an outer thread, with the sleeve secured on a front end of the gear, with a gasket mounted around the sleeve and placed on an outer surface of the fixing plate, with a nut engaged on the sleeve to secure the fixing plate to the outer cylinder, with the screw rod including a coupling portion extending from a front end of the front section of the screw rod and protruded outside the sleeve for connecting with the steel cable of the weight training apparatus, with the adjusting member having an outer diameter approximately the same as an inner diameter of the resistant spring, and with the outer thread of the adjusting member having a thread pitch approximately the same as a spring coil spacing of the resistant spring.

10. The counterbalance device for weight training according to claim 8, with the screw rod including a screw hole disposed in the front section thereof, with a screw extending through a through-hole of a coupling ring and screwed into the screw hole, and with the coupling ring connected to the steel cable of the weight training apparatus.

* * * * *